US005720075A

United States Patent [19]

Rudolf

[11] Patent Number: 5,720,075

[45] Date of Patent: Feb. 24, 1998

[54] MANUAL SUCTION DEVICE FOR TEXTILE MACHINE CLEANING

[75] Inventor: Becker Rudolf, Julius-Leber-Str., Germany

[73] Assignee: Rieter Ingolstadt Spinnereimaschinenbau AG, Ingolstadt, Germany

[21] Appl. No.: 678,963

[22] Filed: Jul. 12, 1996

[30] Foreign Application Priority Data

Jul. 14, 1995 [DE] Germany ..... 295 11 437 U
Jul. 31, 1995 [DE] Germany ..... 195 28 064.4

[51] Int. Cl.[6] ..... D01H 11/00; A47L 5/38

[52] U.S. Cl. ..... 15/301; 15/314; 15/331

[58] Field of Search ..... 15/301, 331, 314

[56] References Cited

U.S. PATENT DOCUMENTS

| | | | |
|---|---|---|---|
| 2,335,460 | 11/1943 | Smellie | 15/331 X |
| 2,625,703 | 1/1953 | Devau | 15/314 X |
| 2,781,164 | 2/1957 | Rowe, Jr. . | |
| 3,011,204 | 12/1961 | Holtzclaw . | |
| 3,030,650 | 4/1962 | Kiraly | 15/331 X |
| 3,311,135 | 3/1967 | Maguire et al. | 15/301 X |
| 3,486,199 | 12/1969 | Herubel . | |
| 4,628,566 | 12/1986 | Klapperich | 15/301 X |
| 5,154,045 | 10/1992 | Saruwatari et al. . | |
| 5,606,767 | 3/1997 | Crlenjak et al. | 15/314 X |

FOREIGN PATENT DOCUMENTS

| | | |
|---|---|---|
| 858961 | 10/1952 | European Pat. Off. . |
| 0192014 | 8/1986 | European Pat. Off. . |
| 418929B1 | 12/1994 | European Pat. Off. . |
| 2364984 | 9/1976 | France . |
| 833769 | 2/1952 | Germany . |
| 1130336 | 5/1962 | Germany . |
| 3717569C1 | 7/1988 | Germany . |
| 4129806A1 | 3/1993 | Germany . |
| 4336078A1 | 4/1995 | Germany . |

*Primary Examiner*—Chris K. Moore
*Attorney, Agent, or Firm*—Dority & Manning

[57] ABSTRACT

The present invention relates to a suction apparatus to be connected to a machine of the textile processing or prepration industry connected to a suction system (1*a*, 1*b*, 14) with a work area (a) and a first suction apparatus (3) which is stationary in the surrounding of the work area for the aspiration of fibers, small parts and/or particles (dirt) from the work area. With it a machine cleaning system is created which is able to clean problem zones of the work area of a machine without imosing a load on the space surrounding the machine. This is achieved if a second suction line (4, 16) in form of a hose that is flexible at least in sections the end (6) of which opening towards the work area (A) of the machine is freely movable for cleaning while its end attached to the machine is connected to the suction system (1*a*, 1*b*, 14) in order to introduce the aspired dirt into the suction system.

9 Claims, 2 Drawing Sheets

MANUAL SUCTION DEVICE FOR TEXTILE MACHINE CLEANING

BACKGROUND OF THE INVENTION

The invention relates to a suction apparatus and process for machine cleaning in the textile machine industry.

In known machines, where material waste or residues generated during the processing of raw materials such as fiber sliver or fleece, undesirable pollution occurs in the work area of the machine. An excessive amount of such pollution in the work area of the machine can adversely influence the operation of the machine or the resulting quality of the raw materials it processes. Therefore such machines are often provided with a machine-based suction system which removes already during processing a major portion of the lighter or smaller dirt particles or material waste produced as a result of the process from the work area.

Usually however, the suction opening is placed at a location of the work area which affects the operation of the machine as little as possible and which is therefore unfavorable with regard to suction performance. Problem zones exist in the work area which are never covered by the standard suction system or where the negative pressure produced by the suction system is insufficient for a thorough cleaning effect. As a result, the work area of such machines must in addition be cleaned manually by operating personnel at regular intervals in order to prevent excessive accumulation of dirt in the problem zones of the machine work area.

In known machines, compressed air is supplied to the machine for this purpose, so that when the machine is switched off and a suitable signal is emitted by the machine indicating that cleaning or a tool or work piece replacement is required and when the operating personnel has opened the machine cover and has thereby uncovered the work area of the machine, the work area can be cleaned by blowing it out with a compressed-air pistol.

In this process the dirt or material waste to be removed is however blown even further into the machine or into the area surrounding the machine, e.g. a machine hall, so that the load on the entire hall increases with the undesirable pollution and raw material residues, even if the specific area of the machine appears to be clean.

OBJECTS AND SUMMARY OF THE INVENTION

It is therefore a principal object of the present invention to create a machine cleaning system which is able to clean the problem zones of the work area of a machine without imposing a load on the space surrounding the machine. Additional objects and advantages of the invention will be set forth in part in the following description, or may be obvious from the description, or may be learned through practice of the invention.

By means of the suction system fixedly installed on the machine and connected to the hose-shaped, flexible second suction air line opening into the work area of the machine, the problem zones of the machine are sucked clean according to the invention and the dirt is reliably removed from the machine. The dirt produced can be conveyed to a filtering system and to waste removal without affecting the surrounding of the machine. The suction system which is already present is given a double purpose and, thus, costs can be saved.

The production or interior space of the machine is thus maintained in a clean condition and maintenance and cleaning intervals can be substantially extended.

Another result is that the air in the machine or production hall is kept clean because of the low content in fibers, small parts, and particles, so that the health hazards to the operating personnel of the machine is reduced overall.

The invention is not limited to draw frames. It can also be used with cards, combing machines or similar machines.

The invention is described in greater detail below through an example of an embodiment and with reference to the drawings.

DETAILED DESCRIPTION OF THE PREFERRED EMBODIMENTS

Figure 1:
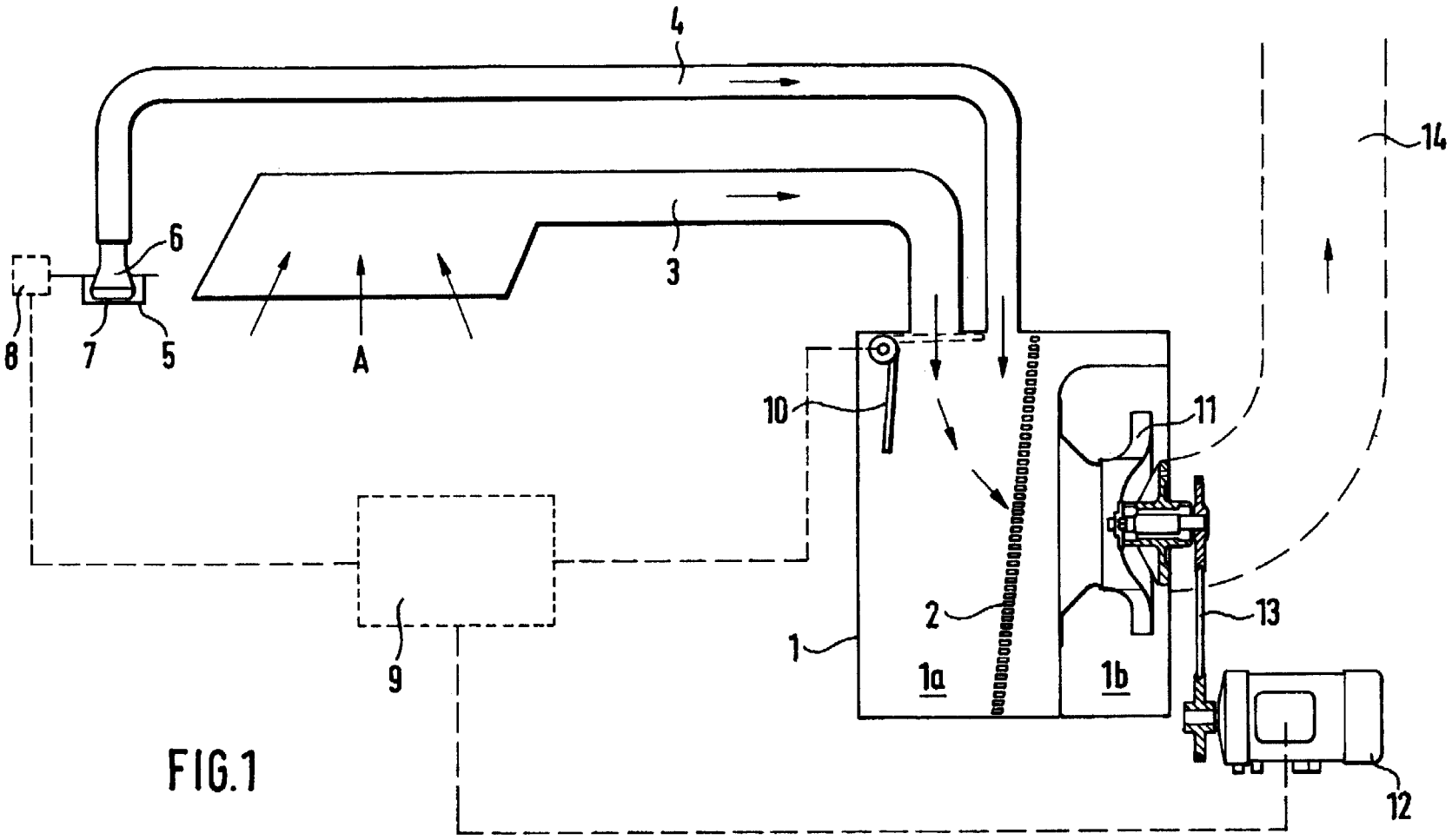
FIG. 1 shows a greatly simplified representation of parts of a suction system on a textile machine (e.g. a draw frame) in combination with the additional suction apparatus 4, 3, 6 in an embodiment given as an example.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present invention cover such modifications and variations as come within the scope of the appended claims and their equivalents.

FIG. 1 shows in simplified representation parts of a suction apparatus in combination with the suction connection or the suction device on a draw frame of a spinning plant for the removal by suction of fibers or fiber residues accumulating during the drawing process.

In a filter housing 1 which may, for instance, be in the form of a filter box or which comprises parts of a filtering system, a filter or sieve 2 is installed. The filter 2 divides the filter housing 1 into a zone 1*a* with air containing fibers or particles into which the air sucked from the working area A of the machine is introduced, and a clean air or exhaust air zone 1*b* located downstream at the rear of filter 2. The pores of filter 2 are sufficiently fine so that particles, fibers or particles of a predetermined size are held back.

In the zone 1*a* with the air to be cleaned a first suction line 3 and a second suction line 4 end in a wall of the filter housing 1. The first suction line 3 ends in a stationary position in the work area A of the machine. The second suction line 4 is flexible at least in sections and made in the form of a hose, comprising a suction nozzle 6 with a suction opening at its end opening into the work area A of the machine.

During the time when the suction nozzle 6 is not needed, a holding device 5 serves to stop the suction nozzle 6 and thereby the second suction line 4 closes relative to the machine. The holding device 5 comprises a suction nozzle locking device 7 which ensures reliable (essentially airtight) closure of the second suction line 4 while the suction nozzle 6 is laid aside and stopped.

A switch-over device 8 connected to the holding device 5, e.g. a switch or a sensor, serves to switch over between normal machine operation and manual or cleaning operation. The switch-over device 8 can be made for this so as to be manually actuated or so that it switches automatically when the suction nozzle 6 of the second suction line 4 is taken out of the holding device 5 and/or when the suction nozzle 6 is again inserted into the holding device 5.

Switch-over is controlled by electric controls 9 which, in response to an actuation of the switch-over device 8, e.g. when the second suction line 4 is taken out of the holding device 5, actuates a suction locking device 10 located in the filter housing 1 in proximity of the outlet of the first suction line 3 in order to close off the outlet opening of the first (stationary suction line 3) while the outlet opening of the second suction line 4 remains open.

The suction locking device 10 may be made in the form of a flap or a slide, it being possible to locate it on the inside of the filter housing 1 as well as on the inside of the first suction line 3, e.g. in form of a butterfly valve.

In the filter housing 1, on the rear side of filter 2, a ventilator or blower 11 is installed and is rotated by a belt drive 12, 13 from the outside of the filter housing 1 to produce the negative pressure required for the aspiration of the pollutants. The drive 12 may be an electrical motor which is also driven by means of the electric controls 9.

As an alternative to the introduction of polluted air into the filter housing 1, it is also possible to provide a connection between the machine and a suction line 14 leading to a central aspiration apparatus. In that case, it is possible to provide for the first suction line 3 to continue letting out in a filter housing 1 of the described type and to be pre-filtered therein or, by leaving out the filter housing 1, to bring it directly from the machine into the suction line 14 leading away from the machine, while the second suction line 4 lets out directly into the suction line 14.

It is possible for the suction locking device 10 to be still located near the outlet point of the first suction line 3, whereby in this manner the controls of the suction locking device 10 can advantageously remain near the machine and filtering and removal of waste air may take place together at a central point of a production course at a distance from the machine.

As an alternative, and with sufficient negative pressure performance of the central aspiration installation, the suction locking device 10 may be omitted entirely, so that the first suction line remains constantly open and constantly aspires, and the air is shut off in the second suction line 4 when it is not in use exclusively through a suitable design of the holding device 5.

Figure 2:
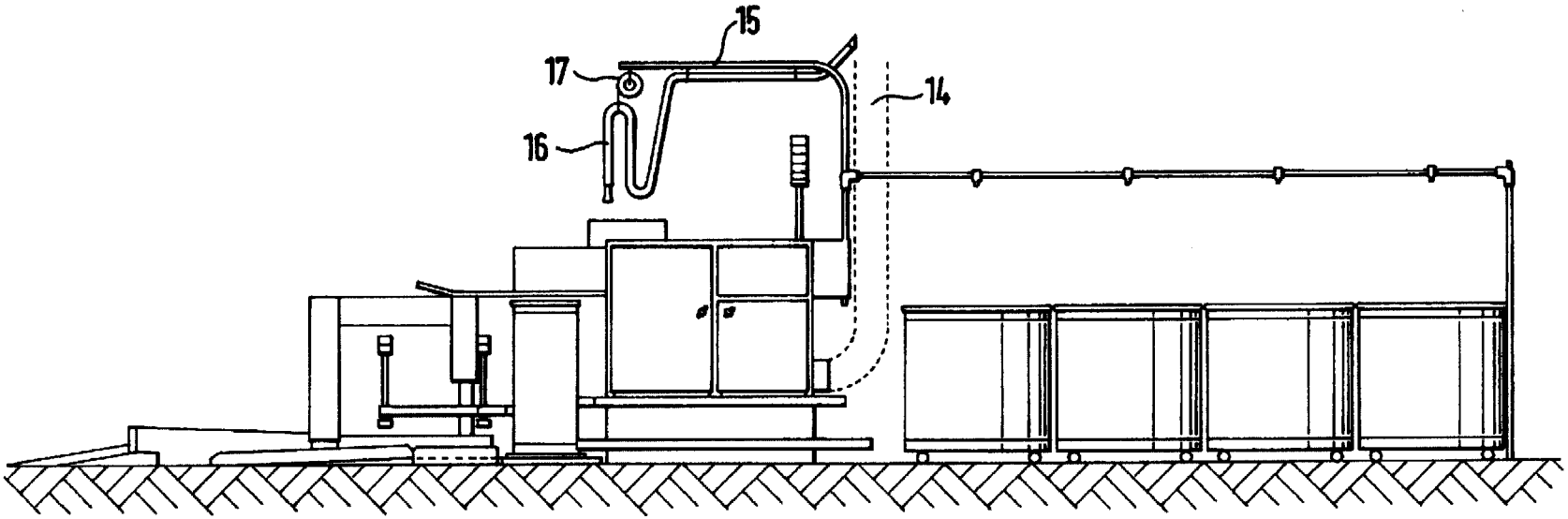
FIG. 2 is a front view of a machine with the suction apparatus 15, 16, 17 in another embodiment

FIG. 2 shows a front view of a draw frame with the additional suction connection 15, 16 whereby the connection of the suction device to a central suction system 14 is shown. The suction line 14 into which the second suction line 4 lets out above the draw frame is indicated by a broken line. The second suction line 4 can be swivelled and is installed relative to a holding device 15 within easy reach of the operator. The second suction line 4 is kept within easy reach near its end 16 bearing the suction nozzle 6 with a projection against a variable telescoping holding device 17. By pulling the end 16, an extension of the second suction line 4 is thus possible, so that all problem zones of the draw frame within the operator's area can be reached with the suction nozzle 6.

Figure 3:
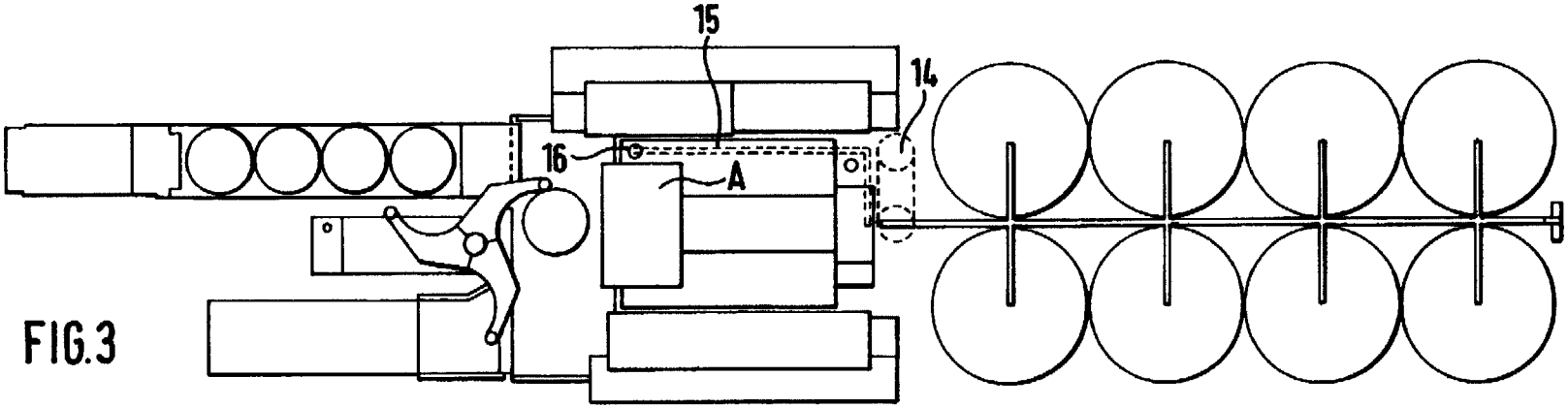
FIG. 3 is a top view of the machine with the suction apparatus in the embodiment of FIG. 2.

FIG. 3 shows a top view of the draw frame in which the suction line 14 as well as a possible course of the holding device 15 with the flexible suction line 16 can be recognized in a broken line.

In the embodiment of the example, a suction line 4, 16 in the form of a hose, permanently attached to the machine is represented. According to the invention it is, however, sufficient if the machine is provided with a connection possibility for such a suction line 4, 16 which is connected to the suction system of the machine. To clean the machine, a suction hose can be connected to such a connection. This hose can be removed from the machine once cleaning is completed, and can be used to clean another machine.

It should be apparent to those skilled in the art that various modifications and variations can be made in the present invention without departing from the scope and spirit of the invention. It is intended that the invention cover such modifications and variations as come within the scope of the appended claims and their equivalents.

I claim:

1. A textile machine suction cleaning apparatus for individual textile machines and mateable with a central suction system, comprising:

a stationary first suction device having a suction end disposed so as to take suction on a working area of said textile machine for aspiration of fiber and particles from said working area, said first suction device in pneumatic communication with said central suction system; and a second movable suction device having a flexible hose section and a free suction end open towards said working area and variably manually movable within said working area, said second movable suction device in pneumatic communication with said central suction system.

2. The suction cleaning apparatus as in claim 1, further comprising a filter housing attachable to said textile machine and in pneumatic communication with said central suction system, said first and second suction devices opening into said filter housing.

3. The suction cleaning apparatus as in claim 2 wherein said filter housing further comprises a filter and blower device for drawing air from said first and second suction devices through said filter to said central suction system.

4. The suction cleaning apparatus as in claim 1, wherein said second movable suction device is connected directly to an exhaust air channel of said central suction system.

5. The suction cleaning apparatus as in claim 1, further comprising a variably positionable locking device disposed relative to said first suction device to block suction therethrough during aspiration of said work area with said second suction device.

6. The suction cleaning apparatus as in claim 5, wherein said locking device is automatically actuated upon use of said second suction device.

7. The suction cleaning apparatus as in claim 1, wherein said second suction device comprises a nozzle at said free suction end thereof, and further comprising a holding device for said nozzle, said holding device further comprising a device to close said nozzle in a substantially air tight manner so as to block suction through said second suction device when said second suction device is not being used.

8. The suction cleaning apparatus as in claim 7, further comprising a variably positionable locking device disposed relative to said first suction device to automatically block suction therethrough during aspiration of said work area with said second suction device, said holding device comprising a switch-over mechanism for automatically actuating said locking device upon removal of said second suction device from said holding device.

9. The suction device as in claim 1, further comprising a telescoping holding mechanism configured with said second suction device which allows for swiveling and telescoping movement of said second suction device relative to said work area.

* * * * *